US008141320B2

(12) United States Patent
Colonias

(10) Patent No.: US 8,141,320 B2
(45) Date of Patent: Mar. 27, 2012

(54) CONSTRUCTION CONNECTOR ANCHOR CAGE SYSTEM

(75) Inventor: Karen Colonias, Danville, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 12/417,470

(22) Filed: Apr. 2, 2009

(65) Prior Publication Data

US 2009/0196694 A1 Aug. 6, 2009

Related U.S. Application Data

(63) Continuation of application No. 10/846,470, filed on May 14, 2004, now abandoned.

(51) Int. Cl.
*E04B 1/38* (2006.01)

(52) U.S. Cl. ..... 52/699; 52/293.3; 52/295; 52/742.14; 52/745.2

(58) Field of Classification Search ..... 52/293.3, 52/294, 295, 633, 699, 742.14, 745.2; 249/34
See application file for complete search history.

(56) References Cited

U.S. PATENT DOCUMENTS

| | | | | |
|---|---|---|---|---|
| 4,736,554 | A * | 4/1988 | Tyler | 52/105 |
| 4,750,306 | A * | 6/1988 | Granieri | 52/251 |
| 5,054,964 | A * | 10/1991 | Salzmann et al. | 405/288 |
| 5,060,436 | A * | 10/1991 | Delgado, Jr. | 52/295 |
| 5,240,224 | A * | 8/1993 | Adams | 249/93 |
| 5,337,534 | A * | 8/1994 | Nasca | 52/745.21 |
| 5,388,804 | A | 2/1995 | Cohen et al. | |
| 5,670,076 | A * | 9/1997 | Leek | 249/53 M |
| 5,937,604 | A | 8/1999 | Bowron | |
| 6,065,730 | A * | 5/2000 | Marks et al. | 248/314 |
| 6,591,574 | B2 * | 7/2003 | Humphrey | 52/678 |
| 6,632,048 | B2 * | 10/2003 | Greenberg | 405/284 |
| 6,679,649 | B1 * | 1/2004 | Capolupo | 404/6 |
| 6,922,968 | B1 * | 8/2005 | Behlen | 52/699 |
| 7,487,597 | B2 * | 2/2009 | Diaz | 33/562 |
| 2002/0083658 | A1 * | 7/2002 | Dial, Jr. | 52/125.4 |

FOREIGN PATENT DOCUMENTS

| | | | |
|---|---|---|---|
| JP | 55161125 | A * | 12/1980 |
| JP | 02038649 | A * | 2/1990 |
| JP | 4-040321 | | 9/1992 |
| JP | 04306365 | A * | 10/1992 |
| JP | 2003-306946 | | 10/2003 |
| WO | WO 9119055 | A1 * | 12/1991 |

OTHER PUBLICATIONS

Office Action dated Oct. 26, 2010, Japanese Patent Application No. 2005-170119, filed May 13, 2005.

Response to Office Action dated Apr. 20, 2011, Japanese Patent Application No. 2005-170119.

English translation of Amended Claims 1-31 filed with Response to Office Action dated Apr. 20, 2011, Japanese Patent Application No. 2005-170119.

Preliminary Search Report dated Jun. 28, 2011, French Patent Application No. 05 04860.

Office Action dated Jul. 19, 2011, Japanese Patent Application No. 2005-170119.

* cited by examiner

*Primary Examiner* — Brian Glessner
*Assistant Examiner* — Adriana Figueroa
(74) *Attorney, Agent, or Firm* — Vierra Magen Marcus & DeNiro LLP

(57) ABSTRACT

An anchor member securing system includes a securing member and a rebar cage structure secured to the member. The securing system may include at least a first foundation placement guide. The anchor members may comprise mudsill anchors and anchor bolts, and the system provides more exact placement of the member or members in a foundation.

31 Claims, 5 Drawing Sheets

CONSTRUCTION CONNECTOR ANCHOR CAGE SYSTEM

CROSS REFERENCE TO RELATED APPLICATION

This application is a continuation of U.S. patent application Ser. No. 10/846,470, entitled "Construction Connector Anchor Cage System," filed on May 14, 2004, which is incorporated herein by reference in its entirety.

BACKGROUND OF THE INVENTION

1. Field of the Invention

The present invention is directed to construction techniques involving anchoring systems.

2. Description of the Related Art

A building is subject to extreme forces from nature. High winds and earthquakes, in particular, cause forces that place considerable strain on the stability of a building. Proper distribution of these forces is critical to ensure the stability of a structure. At the core of building stability is the building's foundation and thus securing the walls of a building to the foundation greatly improves structural performance.

In constructions such as residences and small buildings, a lateral bracing system typically includes vertical studs spaced from each other and affixed to horizontal top and bottom plates. The bottom plate is typically anchored to the floor diaphragm or foundation. The bracing system typically further includes sheathing affixed to the studs, upper plate and/or lower plate to increase structural response to lateral forces. The sheathing used is generally oriented strand board (OSB) or plywood, but fiberboard, particleboard and drywall (gypsum board) are also used. Alternatively or additionally, light-frame construction wall sections may include prefabricated shearwall sections, which can be positioned between the vertical studs and affixed to the studs and the top and bottom connecting plates. The sheathing or prefabricated panels can also be placed adjacent door and window frames to improve the response to lateral forces at these locations.

Shearwalls were developed to counteract the potentially devastating effects of natural phenomena such as seismic activity, high winds, floods and snow loads on the structural integrity of light-framed constructions. Prior to shearwalls and lateral bracing systems, lateral forces generated during these natural phenomena often caused the top portion of a wall to move laterally with respect to the bottom portion of the wall, which movement could result in structural failure of the wall and, in some instances, collapse of the building. Shearwalls within wall sections of light-framed constructions provide lateral stability and allow the lateral forces in the wall sections to be transmitted through the shearwalls between the upper portions of the wall and the floor diaphragm or foundation of the building where they are dissipated without structural effect on the wall or building.

A conventional prefabricated shearwall is anchored to an anchor bolt which extends from a foundation. Anchor bolts in the foundation may also be used with hold-downs in non-prefabricated environments. Much of the time, a concrete contractor places anchor bolts in a foundation to secure these shearwall elements. These bolts must be placed at specific locations in order to mate with the shearwall elements. If the contractor misplaces the anchor bolts, this can create a problem since it will not be recognized until the concrete sets. Since the bolts are critical to ensuring the performance of the shearwall unit, misplacement can be costly.

Hence, proper performance of the shearwall is dependent, at least in part, on the structural integrity of the foundation. Other anchor fasteners could also benefit from correct positioning in the foundation, including mudsill anchors.

It is well known in the construction and building industry that concrete structures, such as foundations, require reinforcement means. Such reinforcement means typically are steel reinforcing bars or rods commonly known as "rebar".

The general procedure followed for forming a concrete foundation includes building wood concrete forms, inserting rebar in the form of rods running the length of the foundation or in the form of a reinforcement cage into the forms, and pouring concrete into the forms.

A problem faced by concrete contractors is ensuring the anchor bolts are properly positioned and their position during creation of the foundation. Normally, a contractor uses a template or plastic bolt holding apparatus such as that disclosed in U.S. Pat. No. 6,065,730 attached to the concrete forms to hold the bolt in place while the concrete is poured, vibrated and set.

The present invention is directed to increasing the accuracy and performance of the placement of anchor bolts, mudsill anchors, or other construction connectors for wood studs or prefabricated structures, such as shearwalls, in foundations, and increasing the integrity of construction using such structures.

SUMMARY OF THE INVENTION

The invention, roughly described, comprises an anchor member securing system. In one embodiment, the securing system includes a securing bolt having a threaded region extending in a generally upward direction and a rebar cage structure secured to the bolt and having at least a first foundation placement guide. In alternative embodiments, other anchor members, such as mudsill anchors, may be utilized rather than anchor bolts. While the present invention will be shown in conjunction with providing a cage structure for anchor bolts, it will be recognized that any anchor member seated in concrete may be utilized in a cage system of the present invention.

In a further aspect, the cage structure includes a top bar and a bottom bar, and the securing anchor member or bolt is attached to said top and said bottom bar. The cage may include a second base bar and first and second side bars forming a rectangular base for said cage structure. Various types of anchor bolts and anchor members may be used in the system in accordance with the present invention.

Still further, the cage structure may include at least a top bar, at least one bottom bar, a first side bar, and a second side bar, each side bar connecting the top bar and the at least one bottom bar, and said securing member is coupled to said top bar and said at least one bottom bar. Additionally, the cage structure may include at least a front bottom bar and a rear bottom bar, and a first base bar and a second base bar, wherein each base bar has a first end coupled to said forward bottom bar and a second end couple to said rear bottom bar, thereby forming a rectangular base.

It should be recognized that any suitably shaped cage structure may be utilized with the present invention, and the invention is not limited to the particular cage structures illustrated and described herein.

In another embodiment, the invention comprises an anchoring system for a shear wall. The anchoring system includes at least one anchor bolt designed secure the shear wall to a foundation element and a foundation cage secured to said at least one anchor bolt.

In a further embodiment, the invention is an anchor system for a building. The anchor system may include an anchor bolt having a threaded end and a cage, adapted for inclusion in a foundation, secured to the anchor bolt in a fixed position relative to the bolt so that the threaded end of the bolt extends above the cage, and having a foundation positioning structure.

In yet another embodiment, the invention is a foundation support system for a building. In this embodiment, the invention includes a first anchor bolt and a second anchor bolt, each having a threaded end. The foundation support system includes a cage structure having a top and bottom portions. The first and second anchor bolts are secured to at least said top and bottom portions such that the threaded end of each said first and second anchor bolt extends above the top portion. In addition, a positioning structure is coupled to the cage structure.

In still another embodiment, the invention is an apparatus, comprising a means for securing a preformed structure to a foundation, and means for positioning the means for securing in a foundation, the means for securing being attached to the means for securing.

In a further embodiment, the invention is a method for constructing a foundation. The method includes the steps of coupling at least one anchor bolt to a rebar cage foundation support; placing the rebar cage in a position in the foundation by aligning a positioning member on the cage relative to a foundation form; and pouring concrete in the foundation form.

The present invention provides a unique method and apparatus to ensure that prefabricated structures attached to building foundations are securely mounted thereto, by providing anchor bolts in a secure relationship to the building foundation forms prior to the foundation pour.

These and other objects and advantages of the present invention will appear more clearly from the following description in which the preferred embodiment of the invention has been set forth in conjunction with the drawings.

BRIEF DESCRIPTION OF THE DRAWINGS

The invention will be described with respect to the particular embodiments thereof. Other objects, features, and advantages of the invention will become apparent with reference to the specification and drawings in which.

DETAILED DESCRIPTION

In accordance with the present invention, an anchor bolt foundation system is provided. In construction projects where pre-fabricated structures such as shear walls are used, the placement of anchor bolts used to secure the structures is a fundamental element of the construction. If the bolts are improperly placed, correction involves shearing the bolt, drilling a hole in the foundation, and securing the bolt in place with epoxy. In some cases, correction may involve destroying and rebuilding the foundation. Increasing the structural integrity of shear walls on both the tension and compression sides of the shearwall can be achieved by increasing the use of rebar in the foundation concrete. However, engineering demands for higher hold downs and shearwall capacity has created a limitation on the concrete connection.

In accordance with the present invention, an anchor cage system is provided. The system provides a rebar cage and anchor bolts correctly positioned relative to the cage and the foundation. The cage is designed to provide the necessary rebar configuration for required tension and compression specifications provided by the building code or structural engineer. In one exemplary embodiment, the present invention is suitable for use with minimum 2500 PSI strength concrete.

Any number of cage configurations designed to meet the requirements of each wall length can be used to give a positive placement for the holdown anchor bolts, as well as the needed end and edge distances. This system ensures the total performance of preformed structure.

Figure 1:
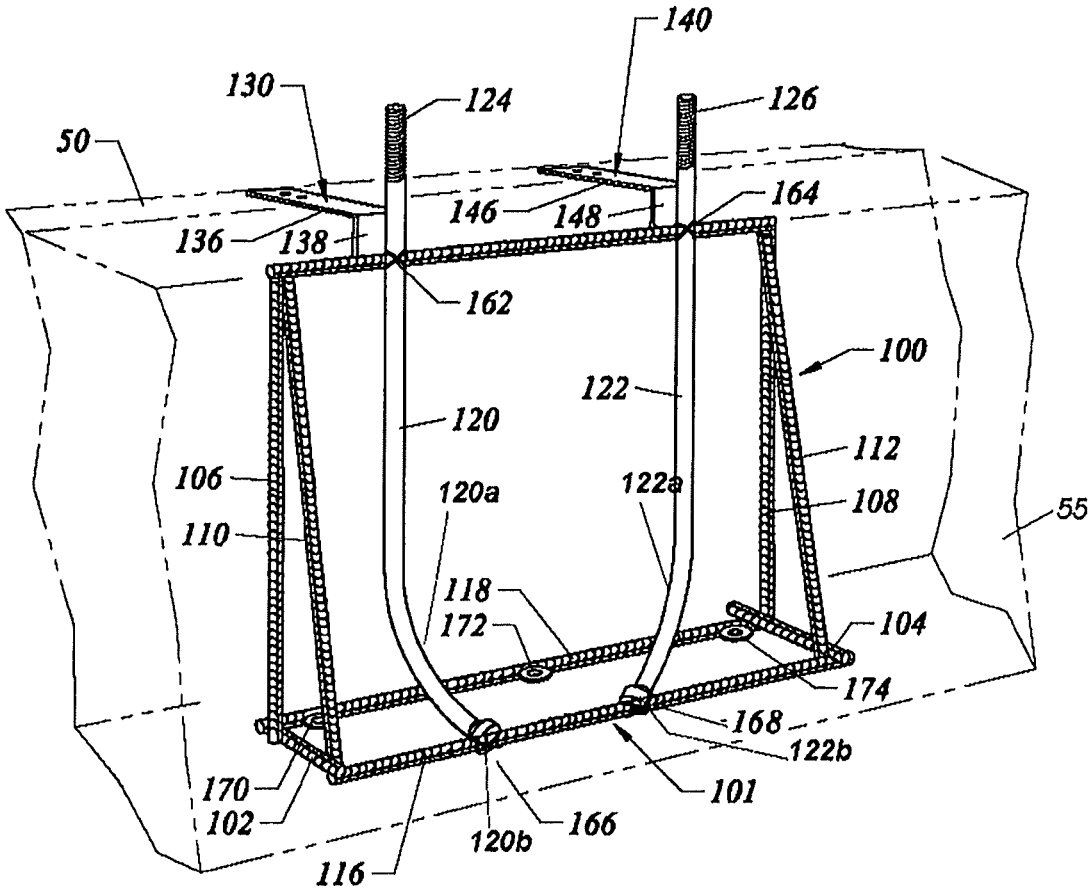
FIG. 1 depicts a perspective view of a first embodiment of an anchor cage system in accordance with the present invention.
Figure 2C:
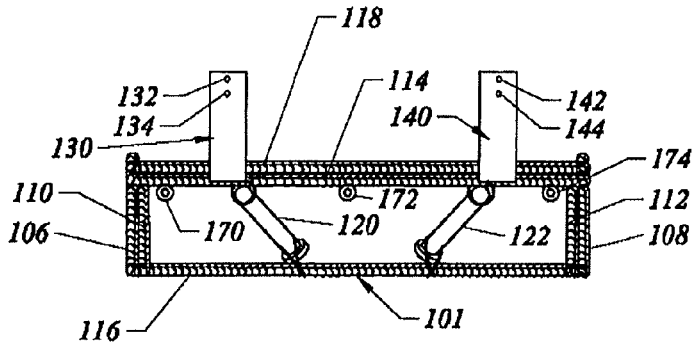
FIG. 2C is a top view of the first embodiment of the anchor cage system shown in FIG. 1.
Figure 2A:
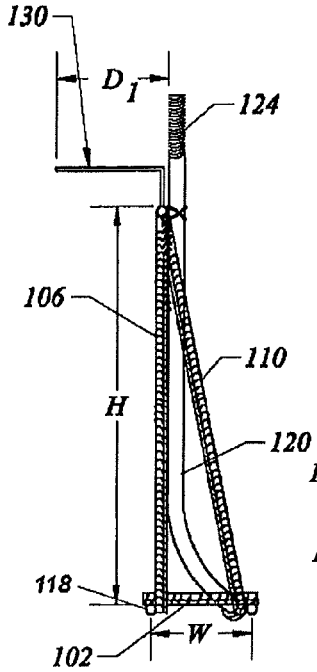
FIG. 2A is a side view of the first embodiment of the anchor cage system shown in FIG. 1.
Figure 2B:
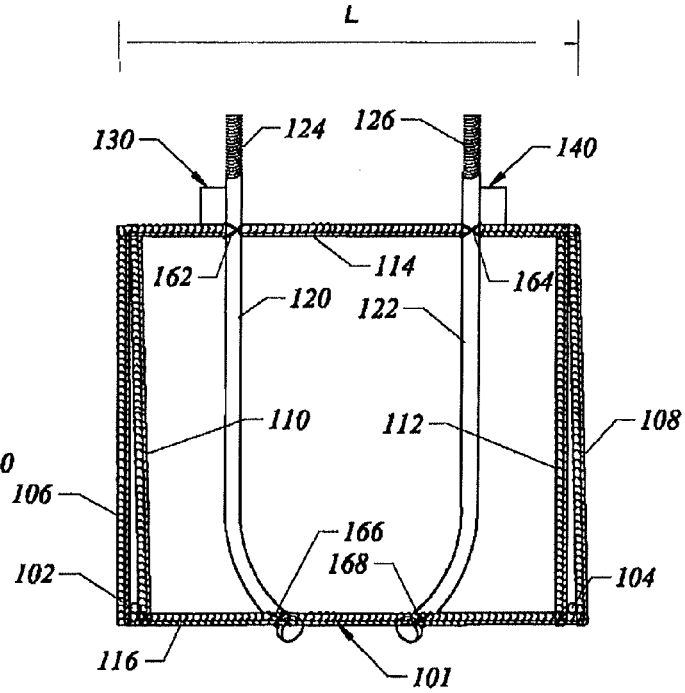
FIG. 2B is a plan view of the first embodiment of the anchor cage system shown in FIG. 1.

FIG. 1 and FIGS. 2A through 2C show first embodiment of the anchoring cage system in accordance with the present invention. FIG. 1 shows a perspective view of an anchoring assembly 100 in accordance with the first embodiment of the present invention. FIG. 2A is a side view, FIG. 2B an elevation view, and FIG. 2C a top view of the anchoring structure 100.

FIG. 1 shows a cage system 100 in a concrete foundation 55 (in phantom). In accordance with the invention, the anchoring cage system allows anchor bolts 120 and 122 to be correctly positioned to secure a shear wall or other structure to a foundation. The cage system 100 is secured to a form or mudsill 50, a portion of which is shown in FIG. 1. Rather than inserting rebar or a separated reinforcement cage reinforcing steel into the forms, the anchor cage system 100 is utilized.

Anchoring structure 100 is suitable for use with anchoring shear walls to a foundation and includes two anchor bolts 120 and 122, which have threaded portions 124 and 126, respectively, designed to extend above the concrete foundation 55 to allow a shear wall or other securing element to be secured thereto. Examples of shear walls are shown in U.S. patent application Ser. No. 10/734,870 as well as United States Patent Publication Number 2003/0009964. Examples of anchor bolts are shown in U.S. Pat. No. Des. 354,905, and are available from Simpson Strong-Tie Company Inc. under part designations SSTB and SSTL. It should be understood that numerous types of shear wall configurations (and indeed other types of prefabricated structure) may be used within the context of the present invention. Other types of anchor bolts other than those disclosed above, as well as other anchor members, such as mudsill anchors, may be incorporated into the present invention. Anchor bolts 120 and 122 are secured to an anchoring cage 101. Cage 101 may be formed out of steel rebar or similar reinforcement materials and may be constructed from a series of elongated bars or rods. The steel rods may be bound together by rebar ties, may be welded together, or otherwise secured in the structures shown herein by any of a number of known means. Alternative constructions of the cage sufficient to support the foundation under provisions of applicable building codes are contemplated as being within the scope of the present invention. Alternative anchor members such as mudsill anchors have securing portions such as straps that extend above the top of the cage and the embedded portion of the anchor.

In one embodiment, anchor bolts 120 and 122 are secured to anchoring cage 100 by tie attachments 162 and 166 (for anchor bolt 120), 164 and 168 (for anchor bolt 122). Securing anchor bolts 120 and 122 to anchoring cage system 101 in the present embodiment ensures accurate placement of bolts 120 and 122 in the foundation. Hence, any suitable means for securing anchor bolts 120 and 122 to cage 101 whereby bolts 120 and 122 will remain in place during a concrete pour may be used in accordance with the present invention. Alternatively, the anchor members may form a portion of the cage itself.

In the embodiment shown in FIGS. 1 and 2, the anchor bolts have a J-shaped configuration. Alternative configurations of bolts 120 and 122, such as those shown in FIGS. 4-5 may be utilized, as well as other shapes of bolts well known in the industry. In the embodiment of FIGS. 1 and 2, the curved ends 120*a* and 122*a* of the anchor bolts lie within the rectangle defined by bars 116, 118 106 and 108. Bolts 120 and 122 may include a nut end 120*b*, 122*b* portion to increase their resistance to pulling forces once embedded in the concrete foundation.

Cage 101 comprises a rebar structure having a top bar 114, side bars 106 and 108, forward bottom bar 116, base bars 104 and 102, and rear bottom bar 118. In the present embodiment, anchor bolts 120 and 122 are connected to top bar 114 and forward bottom 116. In alternative embodiment, the anchor bolts 120 and 122 may be affixed to different elements of the structure 101. Side bars 106, 108, and top bar 114 may comprise a single contiguous piece of rebar which is bent at two points to configure top bar 114 and side bars 106 and 108. Likewise, front bottom bar 116, base bars 102 and 104, and rear bottom bar 118 may comprise one or more connected or contiguous pieces of rebar. Support bar 110 is connected to the intersection of base bar 102 and front bottom bar 116, and side bar 106 and top bar 114. Support bar 112 is connected to the intersection of base bar 104 and front bottom bar 116, and with the intersection of side bar 108 and top bar 114. It should be recognized that a particular construction cage 101 may be accomplished in a number of suitable embodiments, so long as the cage provides a structurally succinct rebar cage for securing anchor bolts 120 and 122.

Also provided on anchor cage 101 are two cage positioning structures 130, 140. In one embodiment, each of structures 130 and 140 includes a horizontal portion 136 and 146, and a vertical portion 138 and 148, respectively. Structures 130 and 140 may be formed of a single piece of steel bent to form the respective horizontal and vertical portions. The structures 130 are coupled to the top bar 114 or structure 101 by the vertical portion 138, 148 through welding or other suitable means. Horizontal plate 136, 146 extends a distance ("D1") (shown in FIG. 2A) between one end thereof and the edge of each anchor bolt 120 and 122. This allows the structure 101 to be positioned correctly with respect to the foundation. Structures 130 and 140 may be secured to form board 50 using any number of types of fasteners provided through bores 132, 134, and 142 and 144, in horizontal portions 136 and 146, respectively.

Base securing structures, 170, 172, and 174 may also be provided coupled to rear bar 118. Base securing structures 170, 172 and 174 may comprise flat steel rings which are welded to rear bar 118 at equidistant points along rear bar 118. Each structure is positioned to lie flat in a plane defined by bars 102, 104, 118 and 116, and abut a surface upon which the cage 101 rests. Structures 170, 172 and 174 can be used to attach cage 101 to an underlying surface.

In one embodiment, cage 101 is formed of number 4 grade 40 rebar, although it should be understood that other grades and sizes of rebar may be used without departing from the scope of the present invention. Various sizes and configurations of the cage are suitable for use in accordance with the invention. In one embodiment, the height ("H") of structure 101 may be approximately 22 inches, the length "W" of side legs 102 and 104 may be approximately 6 inches, and the length "L" of top bar 114 and bottom bar 116 may be approximately 24 inches. In a further embodiment, the anchor bolts have sections 124 and 126 which extend above bar 114 the distance of 3½-7 inches. The length of the bolt may vary between 17 and 37 inches, but is not limited to any particular dimensions.

In operation, once a contractor has created the foundation forms 50 for a concrete foundation, rather than installing separate rebar and using a template or other holder to place the anchor bolts relative to the foundation, the rebar cage system of the present invention may be installed using the respective positioning and/or securing structures. The rectangular base formed by bars 102, 104, 118 and 116 allows the cage system 100 to be placed on the ground within the forms and facilitates attachment to the form boards. Attachment to the form boards ensures that the anchor bolts 120 and 122 will be positioned at the correct position in the form and subsequent foundation. Once the system 100 is in place, the concrete is poured into the forms. Once concrete is poured into a form, it must be compacted in the forms to eliminate trapped air and fill completely around the reinforcing bars. This is generally performed by repeatedly thrusting a rod, space or immersion-type vibrator into the concrete at closely spaced intervals. Use of the present invention provides increased positional stability for the anchor bolts during vibration.

It should be recognized that any number of suitable structures 101 may be used to secure the anchor bolts 120 and 122 in a manner which complies with construction codes for implementing a rebar structure and concrete in a foundation of a construction project. It should be further recognized that the nature of the rebar cage 101 which is utilized in accordance with the present invention may change in accordance with the amount of reinforcement required.

Figure 3C:
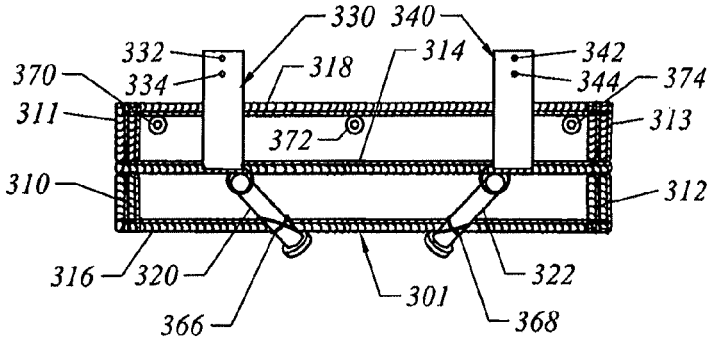
FIG. 3C is a top view of a second embodiment of an anchor cage in accordance with the present invention.
Figure 3A:
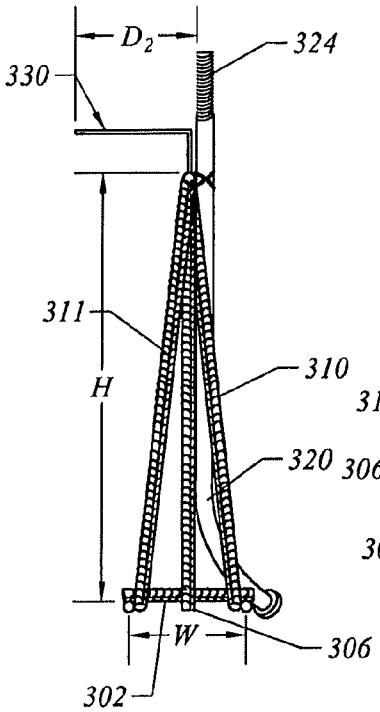
FIG. 3A is a side view of a second embodiment of an anchor cage in accordance with the present invention.
Figure 3B:
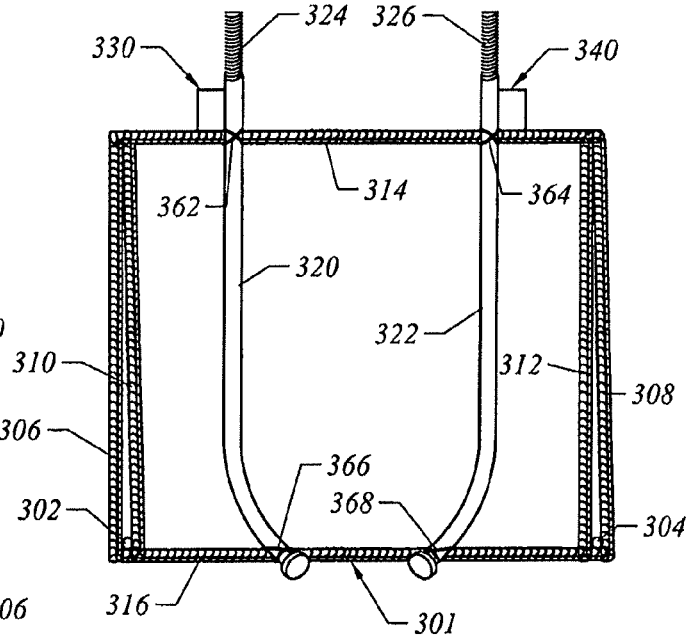
FIG. 3B is a plan view of a second embodiment of an anchor cage in accordance with the present invention.

FIGS. 3A through 3C show an alternative embodiment in the present invention. Cage 301 comprises a rebar structure having a top bar 314, side bars 306 and 308, forward bottom bar 316, base bars 304, 302, and rear bottom bar 318. In the present embodiment, anchor bolts 320 and 322 are connected to top bar 314 and front bar 316. In alternative embodiment, the anchor bolts 320 and 322 may be affixed to different elements of the structure. In this embodiment, additional support bars 311 and 313 are added, and base bars 302 and 304 extend rearward of the side bars 306, 308. The structure 301 is formed from one or more rods of rebar. Support bars 310 and 312 connect the intersection of base bars 302, 304 with front bottom bar 316, and at the intersection of side bars 306, 308, and top bar 314.

In this embodiment, the dimensions of base bars 302 and 304 may remain the same as those in the embodiment of FIGS. 1 and 2. Each anchor bolt 320 and 322 is a J-shaped bolt but as in the embodiment of FIGS. 1 and 2 may comprise alternate configurations. In the embodiment of FIGS. 3A-3C the curved end of the bolt attached adjacent to ties 366 and 368 is position outside the rectangle formed by bars 302, 304, 316 and 318, as best illustrated in FIG. 3C. It should be understood that the position of the bolts may vary relative to the cage so long as the threaded portions remain vertically straight (perpendicular to the plane formed by the rectangle formed by bars 302, 304, 316 and 318.

The distance D2 of the structures 340 and 330 is longer to accommodate the rearward push of the base bars 302 and 304, hence, form structures 340 and 330 have a distance D2 of approximately 5½ inches, and height above middle bar 314 of approximately 2 inches. The length ("W") of side bars 302 and 304 remain at 6 inches. Base securing structures, 370, 372, and 374 may also be provided coupled to rear bar 318.

Figure 4:
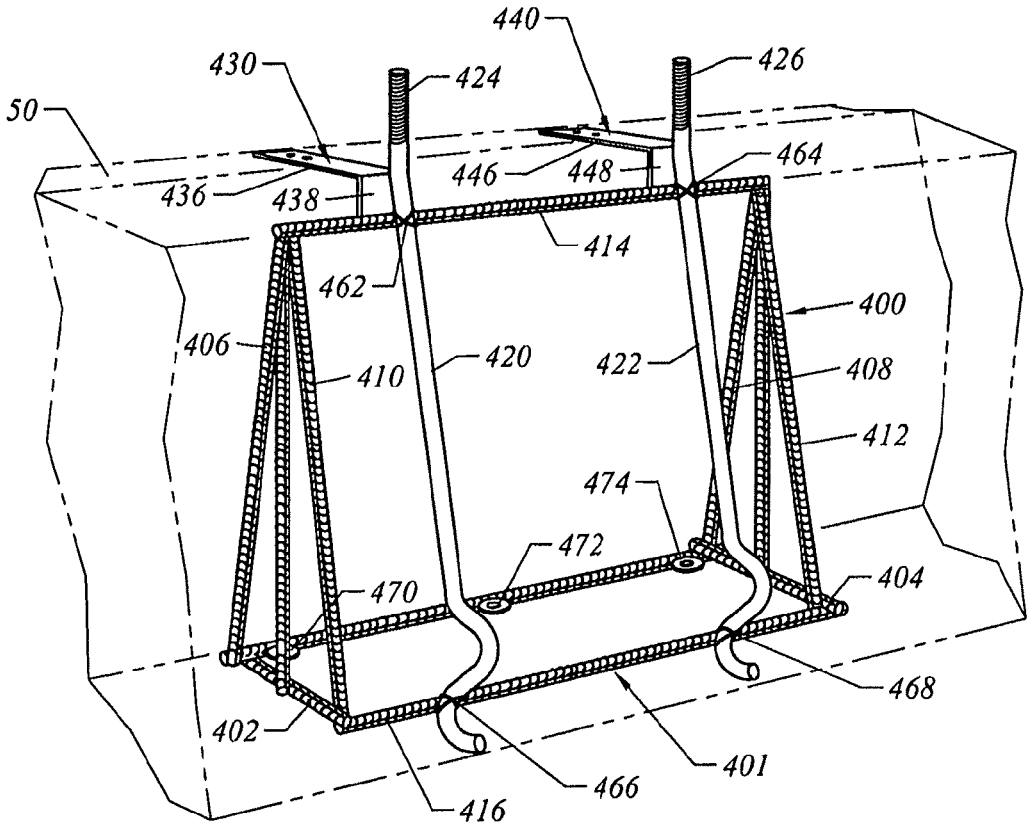
FIG. 4 is a perspective view of a third embodiment of the anchor cage system of the present invention.
Figure 5C:
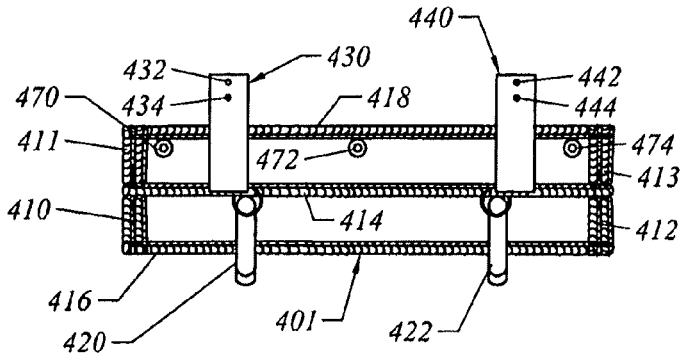
FIG. 5C is a top view of the third embodiment of the anchor cage system shown in FIG. 4.
Figure 5A:
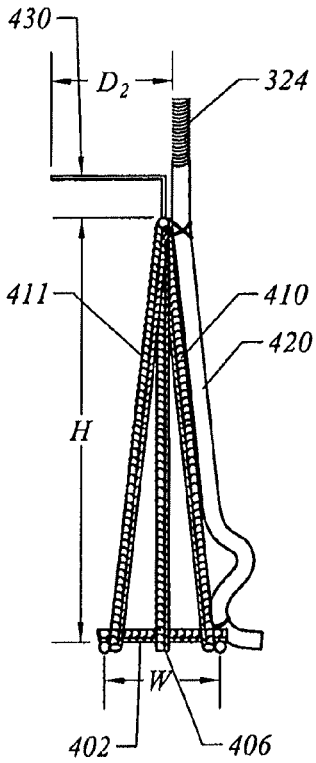
FIG. 5A is a side view of the third embodiment of the anchor cage system shown in FIG. 4.
Figure 5B:
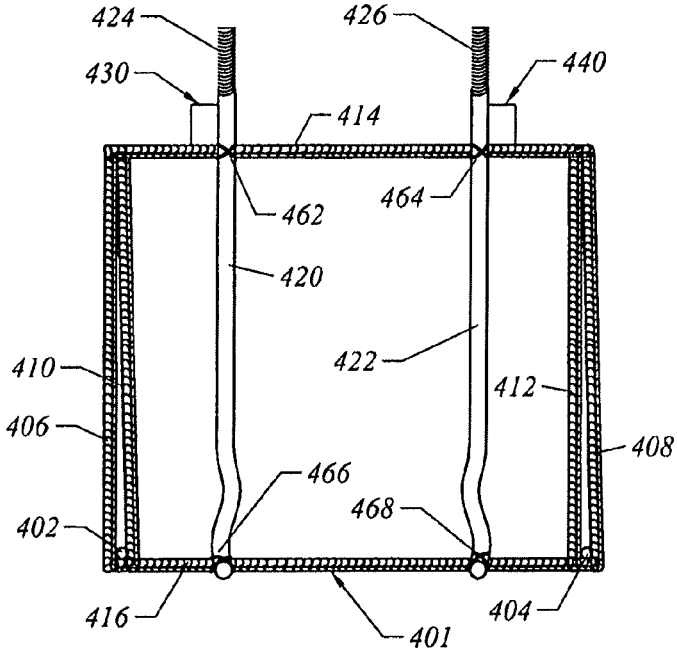
FIG. 5B is a plan view of the third embodiment of the anchor cage system shown in FIG. 4.

Yet another alternative embodiment of the present invention is shown in FIGS. 4 and 5. Cage system 400 includes a cage 401 and anchor bolts 420, 422. Cage 401 is similar in construction to cage 301 shown in FIGS. 3A-3C. Cage 401 comprises a rebar structure having a top bar 414, side bars 406 and 408, forward bottom bar 416, base bars 404, 402, and rear bottom bar 418. Front support bars 410 and 412 connect the intersection of base bars 402, 404, and front bottom bar 416 with the intersection of side bars 406, 408, and top bar 414. Rear support bars 411, 413 connect the intersection of base bars 402, 404, and rear bottom bar 418 with the intersection of side bars 406, 408, and top bar 414. It should be recognized that a particular construction cage 401 may be accomplished in a number of suitable embodiments, so long as the cage provides a structurally succinct rebar cage for securing anchor bolts 420 and 422. Base securing structures 470, 472, and 474 may also be provided coupled to rear bar 418.

In the embodiment of FIGS. 4 and 5, each anchor bolt is provided with a S-shaped end. Anchor bolts of similar construction are shown in U.S. Pat. No. Des. 354,905. Anchor bolts 420 and 422 are an alternative to the anchor bolt shown the first two embodiments of the present invention. Anchor bolts 420 and 422 are connected to cage 401 at an upper end by tie 462, 464 to top bar 414 and at lower end by ties 466, 468 to bottom bar 416. The lower, S-shaped end of the anchor bolt is provided outside of the base of cage 401 formed by sides 402, 404, 416 and 418. It should be recognized that the position of the end of the bolt may be altered based on the type of the bolt so that the threaded portion of the bolt (or securing portion of the member) extending above the structures and the surface of the foundation will be perpendicular to the surface. Again, the bolts may be secured in any manner sufficient to ensure that the bolts retain their position relative to the cage 401 during the foundation pour and cure. The embodiment shown in FIGS. 4 and 5 is installed in a manner similar to that of the previous embodiments. Dimensions of cage 401 are the same as those of cage 301, though it will be understood that all such dimensions are exemplary.

As noted above, the aforementioned cage structures are merely exemplary. Numerous alternative structures may be provided. For example, the rebar cage may comprise a cube structure, a rectangular cube structure, a spherical structure, or any three dimensional structure which allows the anchor member to be supported in the concrete form relative to the form prior to the concrete pour.

The foregoing detailed description of the invention has been presented for purposes of illustration and description. It is not intended to be exhaustive or to limit the invention to the precise form disclosed. Many modifications and variations are possible in light of the above teaching. For example, in the embodiments of FIGS. 3 through 5, the side bars may be removed. The manner of constructing the cage may vary. For example, a single piece of rebar may be bent to form side bars and the top bar in various embodiments. Alternatively, as single piece of rebar may be bent to form the support bars and top bar, the front or rear bottom bars and support bar, the base bars and front or rear bar, (or both) or the like. All such embodiments are contemplated as being within the scope of the present invention. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A method for making an anchor member securing system for use in concrete foundations created using foundation forms, comprising:

providing a first securing member having a securing region extending in a generally upward direction at a first end of the first securing member and a concrete seated end opposing the first end; and constructing a rebar cage structure having a base portion coupled to a top portion by side portions, and at least a first foundation placement guide, the at least first foundation placement guide forming an L-shaped structure that includes a horizontal portion and a vertical portion, the vertical portion of the L-shaped structure directly contacting a top bar at the top portion of the rebar cage structure; and prior to inserting either the first securing member or the rebar cage structure into forms, fastening the first securing member to the top portion and the base portion of the rebar cage structure; and wherein fastening the first securing member to the top portion and the base portion of the rebar cage structure includes fastening the first end of the first securing member to said top bar at the top portion of the rebar cage structure and fastening the concrete seated end of the first securing member to a first bottom bar at the base portion of the rebar cage structure.

2. The method of claim 1 wherein the first securing member is an anchor bolt.

3. The method of claim 2 wherein the securing region is a threaded region.

4. The method of claim 1 wherein the step of constructing the rebar cage structure includes providing a second bottom bar and first and second base bars and forming a rectangular base for said cage structure.

5. The method of claim 4 wherein said step of fastening includes positioning one or more securing structures in a plane formed by said rectangular base, wherein the one or more securing structures are positioned to lie flat in the plane formed by said rectangular base.

6. The method of claim 1 wherein the fastening step includes fastening said first securing member and a second securing member to the top portion and the base portion of the cage structure.

7. The method of claim 1 wherein the constructing step includes fastening a form positioning structure to the rebar cage structure at the at least first foundation placement guide.

8. The method of claim 7 wherein the horizontal portion of the foundation placement guide indicates a proper distance of said rebar cage structure from a foundation concrete form.

9. The method of claim 8 wherein the horizontal portion includes at least one bore allowing a fastener therethrough.

10. The method of claim 7 wherein the step of constructing includes fastening at least two foundation placement guides.

11. The method of claim 1 wherein the constructing step includes fastening the foundation placement guide to the top bar.

12. The method of claim 3 wherein the securing bolt includes an end nut at the concrete seated end.

13. The method of claim 1 wherein the constructing step includes constructing said cage structure having a first side bar and a second side bar, each side bar connecting the top bar and at least one rear bottom bar, and said step of fastening includes fastening the first securing member to said top bar and said first bottom bar.

14. The method of claim 13 wherein the constructing step includes constructing said cage structure having at least a first base bar and a second base bar, wherein each base bar has a first end coupled to said first bottom bar and a second end coupled to said rear bottom bar, thereby forming a rectangular base.

15. The method of claim 14 wherein the constructing step includes constructing said cage structure having a first support bar and a second support bar, the first support bar connected to said top bar and an intersection of said first base bar and first bottom bar, and the second support bar connected to said top bar and an intersection of said second base bar and first bottom bar.

16. The method of claim 15 wherein the fastening step includes fastening at least two securing members to said top bar and said first bottom bar.

17. The method of claim 13 wherein the constructing step includes constructing said cage structure having a first support bar and a second support bar, the first and second support bars connecting said top bar and said first bottom bar.

18. The method of claim 17 wherein the constructing step includes constructing said cage structure having at least a first base bar and a second base bar, wherein each base bar has a first end coupled to said first bottom bar and a second end couple to said rear bottom bar, thereby forming a rectangular base.

19. A method for creating a concrete foundation, comprising;

providing an anchor member having a securing end at a first end of the member and a concrete seated end opposing the first end;

fastening the anchor member to a cage structure such that the anchor member is pre-secured in a fixed position relative to the cage structure so that the securing end of the anchor member extends above a top portion of the cage to create an assembled structure, the cage structure having a foundation positioning structure, the foundation positioning structure including an L-shaped structure, the L-shaped structure including a horizontal beam and a vertical beam, the vertical beam of the L-shaped structure directly coupled to a top bar at the top portion of the cage structure;

constructing concrete forms suitable defining at least a border of the concrete foundation; and positioning the assembled structure in the forms; and wherein fastening the anchor member to the cage structure includes fastening the first end of the anchor member to said top bar at the top portion of the cage structure and fastening the concrete seated end of the anchor member to a front bottom bar of the cage structure.

20. The method of claim 19 wherein the anchor member is an anchor bolt.

21. The method of claim 20 wherein the securing end is a threaded end.

22. The method of claim 19 wherein the cage structure includes a second bottom bar and first and second base bars forming a rectangular base for said cage structure.

23. The method of claim 21 wherein the anchor member includes an end nut opposite to the threaded end.

24. The method of claim 19 wherein the horizontal beam extends from the cage structure indicating a proper distance of said cage structure from a foundation form.

25. The method of claim 24 wherein the horizontal beam includes at least one bore and the method includes attaching the assembled structure to the forms using a fastener through the bore.

26. The method of claim 24 wherein the foundation positioning structure includes at least two foundation placement guides.

27. A method for creating a concrete foundation support system for a building, comprising:

providing a first anchor bolt having a threaded end;

providing a second anchor bolt having a threaded end;

fastening the first anchor bolt and the second anchor bolt to a cage structure having a top and bottom portions to create an assembled fastening system, the first and second anchor bolts being secured to at least said top and bottom portions prior to the positioning of the fastening system and the application of concrete in the concrete foundation support system, the first and second anchor bolts being pre-secured such that the threaded end of each said first and second anchor bolt extends above the top portion; and attaching a positioning structure coupled to the fastening system, the positioning structure forming an L-shaped structure that comprises a horizontal portion and a vertical portion, the vertical portion of the L-shaped structure directly contacting a top bar at the top portion of the cage structure; and wherein fastening the first anchor bolt and the second anchor bolt to the cage structure includes fastening the respective threaded ends of the first anchor bolt and the second anchor bolt onto said top bar of the top portion of the cage structure and fastening respective concrete seated ends of the first anchor bolt and the second anchor bolt opposing the respective threaded ends of the first anchor bolt and the second anchor bolt onto a first bottom bar of the bottom portion of the cage structure; and the cage structure including a first support bar and a second support bar, the first support bar connected to said top bar and said first bottom bar, the second support bar connected to said top bar and said first bottom bar, the first support bar not contacting the second support bar.

28. The method of claim 27 wherein the cage structure includes a second bottom bar and first and second base bars forming a rectangular base for said cage structure.

29. The method of claim 27 wherein the bottom portion includes a rear bottom bar, and a first base bar and a second base bar, wherein each base bar has a first end coupled to said first bottom bar and a second end coupled to said rear bottom bar, thereby forming a rectangular base.

30. The method of claim 27 wherein each of said anchor bolts is coupled to said top bar and said first bottom bar.

31. The method of claim 28 wherein the cage structure includes a third support bar and a fourth support bar, the third support bar connected to said top bar and an intersection of said first base bar and said second bottom bar, the fourth support bar connected to said top bar and an intersection of said second base bar and said second bottom bar, the third support bar intersecting the first support bar at a first end of the top bar, the fourth support bar intersecting the second support bar at a second end of the top bar opposing the first end of the top bar.

* * * * *